US005183334A

United States Patent [19]

Geistlinger

[11] Patent Number: 5,183,334

[45] Date of Patent: Feb. 2, 1993

[54] PAINT CAN SHAKER

[76] Inventor: Dewey F. Geistlinger, Box 154, Rte. 1, DeWitt, Nebr. 68341

[21] Appl. No.: 681,976

[22] Filed: Apr. 8, 1991

[51] Int. Cl.[5] ..... B01F 15/00

[52] U.S. Cl. ..... 366/129; 366/209; 366/605; 294/153

[58] Field of Search ..... 366/129, 130, 208, 209, 366/210, 211, 213, 215, 218, 219, 237, 238, 348, 349, 604; 182/46, 196; 294/137, 158, 167, 154, 153, 170, 142; 248/318; 224/148; 134/117, 118; 68/213, 171, 172

[56] References Cited

U.S. PATENT DOCUMENTS 249,846 11/1981 MacDonald ..... 182/196
1,989,019 1/1935 O'Keeffe ..... 366/130
3,224,742 12/1965 Hiser ..... 366/130
4,139,080 2/1979 Wells ..... 182/196
4,325,503 4/1982 Swinney ..... 224/148

*Primary Examiner*—Robert W. Jenkins
*Attorney, Agent, or Firm*—Vincent L. Carney

[57] ABSTRACT

To provide mixing of paint in a 1 gallon can, a tubular member is passed through the handle of the 1 gallon can and suspended from a tubular handle held by the operator by members sufficiently short so the can is lifted from the ground when a person holding the handle has his arm extended downwardly and is standing. The user then gently moves his hand and wrist so as to cause a resonant pendulum-like motion of the can about the pivot points of the paint can handle so as to mix the paint within it.

8 Claims, 2 Drawing Sheets

PAINT CAN SHAKER

BACKGROUND OF THE INVENTION

This invention relates to apparatus and methods for mixing the ingredients of a container.

In one class of such apparatuses and methods, a container is mounted in a simple apparatus which is moved back and forth to mix the ingredients. One prior art apparatus of this class includes a rigid cradle for holding a container, which cradle includes a downwardly extending member to be positioned on the ground and an upwardly extending handle that is to be manually moved back and forth. This type of apparatus has the disadvantage of being limited in the thoroughness of stirring accomplished in a limited period of time. Consequently, painters frequently utilize automatic machinery which has the disadvantage of being expensive and complicated.

SUMMARY OF THE INVENTION

Accordingly, it is an object of this invention to provide a novel apparatus for mixing the ingredients of a container.

It is a further object of the invention to provide a novel method for mixing the ingredients of a container.

It is a still further object of the invention to provide a compact, lightweight apparatus capable of holding a container and permitting its rapid movement about an axis which passes through the container by the simple operation of a single person.

It is a still further object of the invention to provide a method of mixing the ingredients of a container in which the container is easily suspended from a simple fastener held by a person and caused to rapidly pivot about the container's handle by relatively easy motion of the person holding the fastener.

In accordance with the above and other objects of the invention, a mixer includes a handle, a spacer, and a fastener means for connecting the spacer to a container, the ingredients of which are to be mixed. The spacer extends between the handle and the fastener means. The handle is of sufficient size to permit the painter to hold it in one hand and the fastener means is adapted to be connected to and spaced from the handle by the spacer in such a way that movement of the handle causes a mixing motion of the container. In the preferred embodiment, the container is a paint can.

In one embodiment, the spacer includes two flexible cords attached at opposite ends of the handle with sufficient space between them to allow a person to hold the handle. The two flexible members extend downwardly and are connected to the fastener means. The fastener means may be a straight bar sized so that it can fit within and hold a wire handle on a paint can or other type of container.

The flexible members have a length of between two and one-half inches and two feet and preferably six and one-half inches in length. In the preferred embodiment, the fastener means is an eight inch long bar mounted near each end to a different one of the flexible members. The fastener means may have a length of between 4 inches to 12 inches and the spacer may be attached one and three-quarter inches from the end so that the fastener means can be inserted in a paint can hoop as a carrier for the paint can and as a device for mixing. The spacer may have a length of between 3 inches and 2 feet and be connected between ⅛ inch and 5 inches from each end.

In use, a person holds the handle of the mixer with a container suspended beneath it by a spacer and moves his arm or hand in such a fashion as to cause the container to rapidly rotate repeatedly back and forth through arcs of less than 300 degrees about an axis through the container with the arcs being in the lower portion of a vertical circle about the axis. The axis through the container passes through the pivot points of the wire handle for the container when the container is a paint can. This is done to create a resonant rotating which provides turbulence and folding over of the paint within the container. The rate of rotating differs with the location of the center of gravity and the weight of the filled container, the ingredients of which are being mixed.

From the above description, it can be understood that the mixer of this invention has several advantages, such as: (1) it is simple in construction and inexpensive to make; (2) it is portable and easily carried around; (3) it may be used to carry containers; (4) it is easy to use by one person; and (5) it provides rapid and efficient mixing of the ingredients of a container.

DESCRIPTION OF THE DRAWINGS

The above noted and other features of the invention will be better understood from the following detailed description when considered in connection with the accompanying drawings, in which.

DETAILED DESCRIPTION

Figure 1:
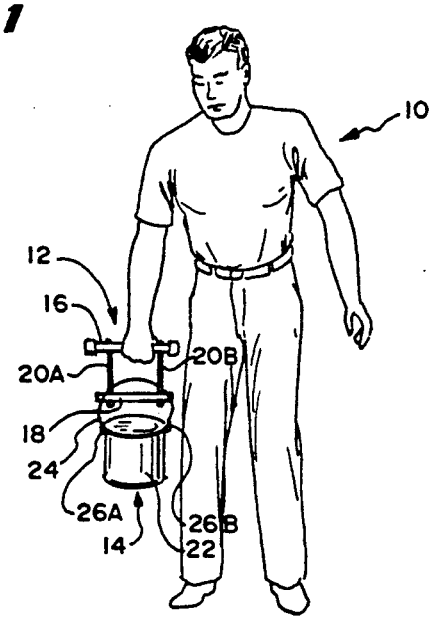
FIG. 1 is a perspective view of a person utilizing the mixer of this invention.

In FIG. 1, there is shown a simplified perspective view of a person 10, a shaker 12 and a container 14. The container 14 is fastened to the lower portion of the shaker 12 and the person 10 is holding the upper portion.

As shown in FIG. 1, the person 10 holds the shaker 12 in one hand in a position that elevates the container 14 so that the person 10 may carry the container 14 from place to place using the shaker 12, if desired. However, its principal use is in mixing the ingredients of the container 14 and for this purpose, the person 10 holding the shaker 12 moves his hand and/or arm slightly so that the shaker 12 causes the container 14 to pivot rapidly about an axis through the container in repeated arcs of less than 300 degrees of the lower portion of a vertical circle having the axis as a center at a rate that depends, to some extent, on its center of gravity and weight. This causes rapid mixing of the ingredients without excessive exertion by the person 10.

The shaker 12 includes a handle 16, one or more spacers 20A and 20B and a fastening means 18. The container 14 includes a container body 22 and a container handle 24. The fastening means 18 is adapted to easily engage the container handle 24 which is pivotably fastened to the container body 22 along an axis at the pivot points 26A and 26B.

In the preferred embodiment, the handle 16 is an elongated bar having two spacers 20A and 20B. In the embodiment of FIG. 1, the spacers 20A and 20B are flexible, each fastened to the handle 16 at one end and fastened at their other ends to the fastening means 18. There is sufficient distance between the fastening points of the members 20A and 20B to the handle 16 to permit the user to grab and hold the bar 16 horizontally with one hand.

In the illustration of FIG. 1, the container 14 is a 1 gallon paint can having the container body 22 to hold the paint and a conventional semi-circular wire container handle 24 pivotally connected at the points 26A and 26B to the paint can body 22.

The fastening means 18 of the shaker 12 is an elongated bar, with ends extending from the fastening points of the members 20A and 20B to be slipped through a wider portion of the wire handle 24 and pulled upwardly to engage the handle 24. The fastening means 18 is sufficiently small to be easily inserted through the container handle 24 but is sufficiently long to extend on both sides of the container handle 24 after engagement.

The dimensions of the shaker 12 are selected to permit the container 14 to be held above ground and be pivotally rotated about an axis without excessive force by the user. It is intended to cause the members 20A and 20B to snap vigorously as the arm of a person swings through a relatively small arc with minor twisting of the wrist so that lifting and minor twisting of the wrist so that lifting and lowering using the biceps of the arm are not necessary.

In use, the person wishing to carry or shake the container 14 takes the fastening means 18 and slips it under the container handle 24 so that it engages the container handle 24 at two points and the container handle 24 is free to rotate. He then lifts the container 14 by holding the handle 16 so that he can carry a paint can or other container 14 from place to place.

To use the shaker 12 for mixing, the handle 16 and fastening means 18 are held horizontally while the person doing the shaking swings his arm or rotates his wrist or both in arcs about his shoulder and/or wrist of less than 200 degrees to cause a rapid pivoting action about an axis of the paint container 14, which action vigorously causes tumbling and mixing of the ingredients. The mixing may be aided by the orbiting of the container body 22 in partial arcs about the user's shoulder and wrist and about the arc of the position at which the handle 24A and fastening means 18 meet when the shaker 12 is being used. The amount of time it takes to mix the ingredients is between 20 seconds and 10 minutes but is usually about 40 seconds.

Figure 2:
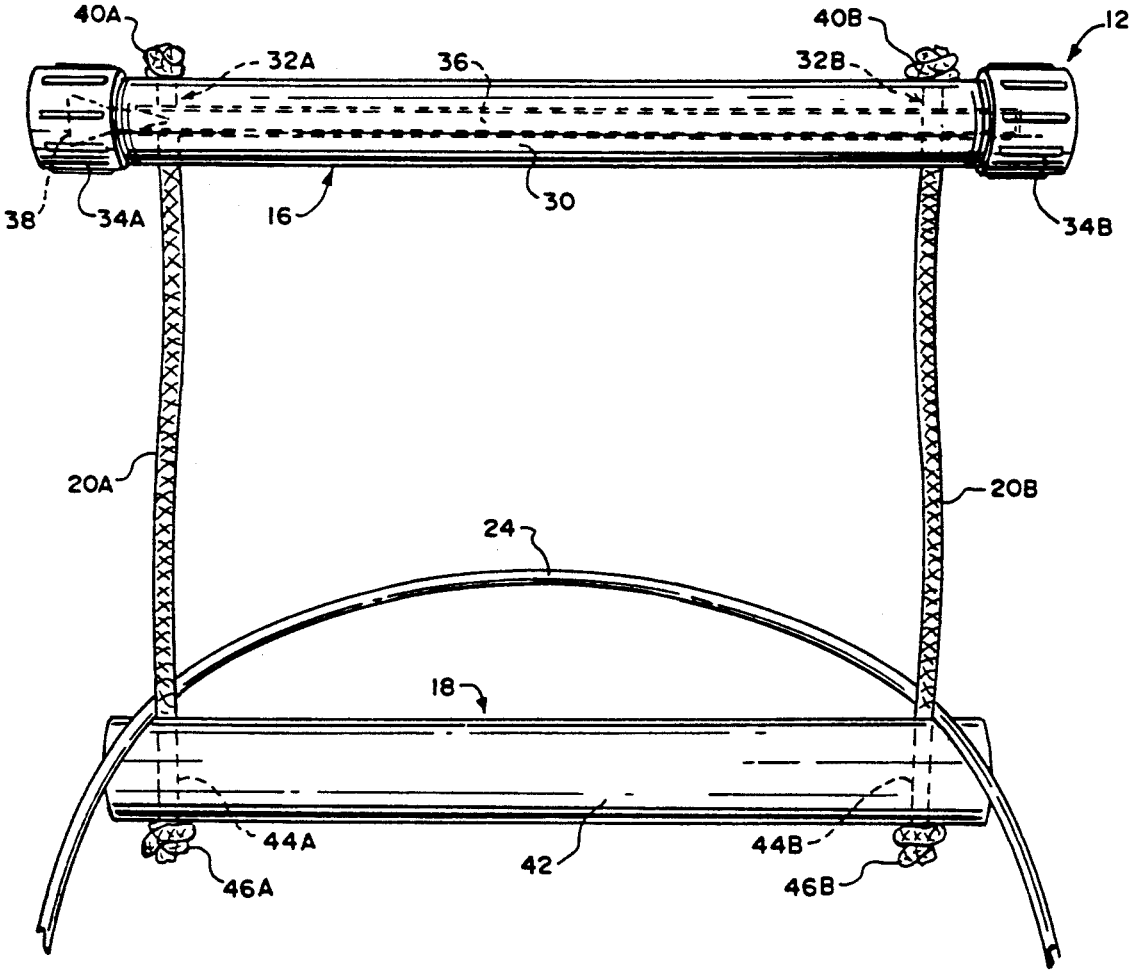
FIG. 2 is a front elevational view of an embodiment of the mixer in accordance with the invention.

In FIG. 2, there is shown an elevational view of the shaker 12 with the handle 16, members 20A and 20B and fastening means 18 shown in greater detail. As best shown in this view, the handle 16 includes a ¾ inch polyvinyl chloride SC40 or stronger tube 30, first and second drilled holes 32A and 32B, end pieces 34A and 34B, a central handle for can closing 36 and a lid opening tool 38.

In the embodiment of FIGS. 1 and 2, the spacers 20A and 20B are flexible members such as twine or nylon rope. The two ⅜ inch drilled holes 32A and 32B of the handle 16 are sized to receive the spacers 20A and 20B which are knotted at 40A and 40B or tied to other holding means to fasten the ends of these flexible spacers 20A and 20B to the handle 16.

The lid removing tool 38 is a pointed metal tool with a handle fitted within the end piece 34A so that it may be used to pry open the cover of a paint can and to receive the hollow tubular central handle 36 which is fastened at its other end to the end piece 34B. The end piece 34B is sufficiently hard and can be used to pound the cover closed by someone holding the tubular central member 36.

With this arrangement, the spacers 20A and 20B are passed through the holes 32A and 32B and fastened on the opposite side with their free ends being mounted to the fastening means 18. The first end piece 34A is placed in position with the lid opening tool 38 in place with the lid opening tool 38 inserted within the central handle 36 to hold its free end in place within the tube 30 and its second end piece 34B attached.

To mount the fastening means 18 to the handle 16, the handle 16 includes a ¾ inch polyvinyl chloride SC40 or stronger tube 42 with two ⅜ inch holes 44A and 44B drilled through them. The holes 44A and 44B, in the preferred embodiment, are 5½ inches apart whereas the holes 32A and 32B in the tube 30 of the handle 16 are 7¼ inches apart so that the spacers 20A and 20B extend inwardly to provide a better hold on the container handle 24 (FIG. 1). The inward curvature also tends to reduce the tendency of the unit to twist so that the ends 46A and 46B of the spacers 20A and 20B slant inwardly towards each other at an angle.

The spacers 20A and 20B pass through the holes 44A and 44B and are knotted at 46A and 46B to hold them in place and space the handle 16 and the fastening means 18 apart from each other. The fastening means 18 is, in the preferred embodiment, 8 inches in length so that container handle 24 fits over the ends of the tube 42 outside of the spacers 20A and 20B adjacent to the handle 24 and up over the handle 24 to be held in place between the spacers 20A and 20B and the tube 42. However, the fastening means 18 may have a length of between 4 inches and 12 inches.

Figure 3:
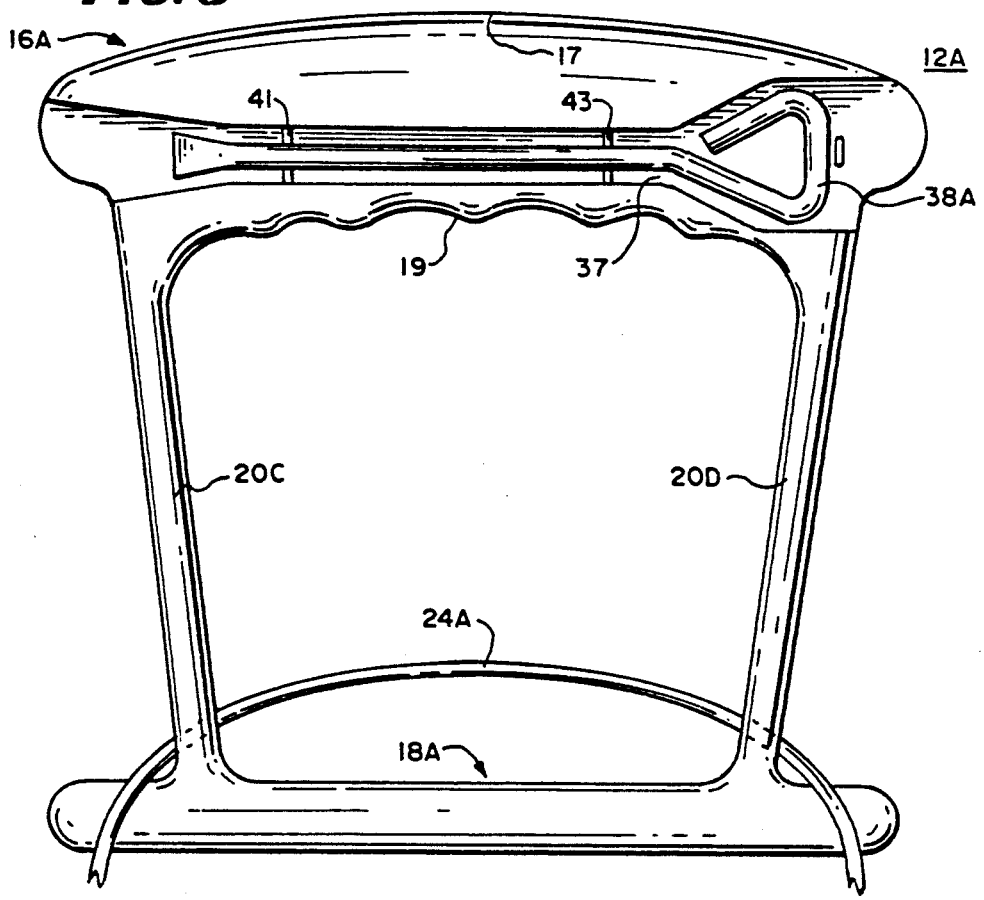
FIG. 3 is a front elevational view of another embodiment of the mixer in accordance with the invention.

In FIG. 3, there is shown a front elevational view of another embodiment of the shaker 12A. In this embodiment the shaker 12A is of one-piece construction to allow it to be injection molded thereby decreasing the cost of manufacturing.

The shaker 12A consists of a handle 16A, spacers 20C and 20D and fastening means 18A. The handle 16A has a curved portion 17 and a scalloped edge 19 to allow the user to grip the handle 16A. On the front of the handle 16A, there is an opening 37 to allow a lid opening tool 38A to snap into position in the members 41 and 43. The lid opening tool 38A is also of one-piece construction. It is an elongated member with one end able to pry open a can and its other end forming a triangular handle.

The spacers 20C and 20D attach the handle 16A to the fastening means 18A. In this embodiment, the spacers 20C and 20D are not flexible members but still allow the user to: (1) pivotally rotate the shaker 12A about the axis of the point at which the container handle 24A is attached to the container 14 (FIG. 1); (2) orbit the container body 22 (FIG. 1) about the user's shoulder and wrist through an arc directed toward the ground and in front of and behind the person 10 (FIG. 1); and (3) orbit the container body 22 about the arc of the position at which the handle 24A and fastening means 18A meet when the shaker 12 is being used. Orbiting of the container body 22 may not be required for the mixing of the contents of the container 16A.

Figure 4:
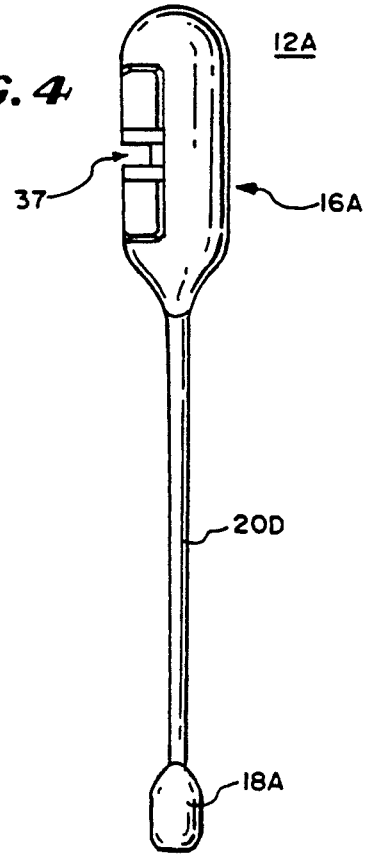
FIG. 4 is a side elevational view of the embodiment of FIG. 3.

FIG. 4 is an elevational left side view of the shaker 12A of FIG. 3 showing the handle 16A, opening 37, member 20D and fastening means 18A. The width of the handle 16A must be wide enough to accommodate the lid opening tool 38A (FIG. 3), but small enough to be gripped by a user. In the preferred embodiment, the width of the handle 16A is one inch but can be between ½ inch and four inches. The spacers 20C (FIG. 3) and 20D and the fastening means 18A should each be at least ⅛ inch.

In the embodiment of FIGS. 3 & 4, the spacers 20C and 20D are elongated, straight members formed at angles that cause the spacers 20C and 20D to be: (1) farther away from each other at the points at which they are connected to the handle 16A; and (2) closer to each other at their connections to the fastening means 18A. The spacers 20C and 20D could be a singular member extending from the handle 16A to the fastening means 18A with an aperture near the handle 16A large enough to allow the hand of a user to grip the underneath of the handle 16A.

In all of the embodiments: (1) the handles 16 and 16A may have a length of between 4 inches and 2 feet and a width of between ½ inch and 4 inches; (2) the spacers may have a length of between 3 inches and 2 feet and be between ⅛ inch and 5 inches from each end of the fastener and handle; and (3) the fastening means may have a length of between 4 inches and 12 inches. Preferably, the handles 16 and 16A and fastening means 18 and 18A are 8 inches in length and the spacers are 5½ inches apart on the fasteners and are 7¼ inches apart on the handle.

From the above description, it can be understood that the shaker of this invention has several advantages such as: (1) it is simple and inexpensive to manufacture; (2) it is compact and portable; (3) it can be used for multiple purposes; (4) it provides a pendulum-like resonant action which thoroughly mixes the ingredients of a container; and (5) it can easily be used by an individual.

Although a preferred embodiment of the invention has been described with some particularity, many modifications and variations of the invention are possible within the light of the above teachings. It is therefore to be understood that, within the scope of the appended claims, the invention may be practiced other than as specifically described.

What is claimed is:

1. A method of mixing paint comprising the steps of:

inserting a container holder of a paint mixer into a handle of a can of paint wherein the handle is connected to the can of paint at pivot points located along an axis extending through the can of paint;

gripping a handle of the paint mixer;

lifting the paint mixer whereby an elongated flexible member is extended;

holding the paint mixer wherein a user's arm holding the paint mixer is extended downwardly; and moving the paint mixer in a manner to cause the can of paint to mix rapidly wherein the can of paint follows a partial orbital path about the user's shoulder causing the can of paint to rotate about the axis extending through the can of paint.

2. A method of mixing the contents of a container comprising the steps of:

mounting a handle of a container to a fastener, wherein the handle of the container is connected to the container at pivot points so as to permit pivotal motion of the container;

holding the fastener from a spacer; and moving the spacer at such a speed as to cause pivoting of the container about its pivot points.

3. A method according to claim 2 in which the spacer is mounted to a handle of sufficient size to be grasped by a person and is of such a length that the container is suspended from the ground when held by the person with his arm extended.

4. A method in accordance with claim 3 further comprising the step of removing a wedge from the handle and using it to pry open the cap of the container.

5. A method according to claim 4 further comprising the step of forcing the cap closed using a removable end from the handle.

6. A mixer comprising:

a handle;

a fastener;

a spacer connecting the handle and the fastener;

said handle, spacer and fastener being arranged so that a container having a handle may be thrown into a pendulum-like motion about an axis by slight movement of the handle of the mixer;

the length of the spacer being such that the container is maintained above ground when the handle of the mixer is held in a hand of a person with the person's arm extending straight downwardly;

the handle of the mixer being an elongated member having a length of between 4 inches and 2 feet, the spacer having a length of between 3 inches and 2 feet and the fastener being an elongated member having a length of between 4 inches and 12 inches.

7. A mixer in accordance with claim 6 in which two spacers are included which are spaced apart on the handle of sufficient distance for the hand of a person and extending at an angle inwardly to the fastener;

said fastener being elongated and shaped to receive portions of a container handle.

8. A mixer in accordance with claim 6 in which the member is flexible and includes two elongated rope-like members extending from the handle to the holder at an angle with bottom ends of the members being closer together than top ends of the members at the handle.

* * * * *